US006664037B2

(12) United States Patent
Mizuno

(10) Patent No.: US 6,664,037 B2
(45) Date of Patent: Dec. 16, 2003

(54) SILVER HALIDE EMULSION AND METHOD FOR CHEMICAL SENSITIZATION THEREOF

(75) Inventor: Masafumi Mizuno, Minami-ashigara (JP)

(73) Assignee: Fuji Photo Film Co., LTD, Kanagawa (JP)

( * ) Notice: Subject to any disclaimer, the term of this patent is extended or adjusted under 35 U.S.C. 154(b) by 0 days.

(21) Appl. No.: 10/167,386

(22) Filed: Jun. 12, 2002

(65) Prior Publication Data

US 2003/0082491 A1 May 1, 2003

(30) Foreign Application Priority Data

Jun. 15, 2001 (JP) ..... 2001-181198

(51) Int. Cl.[7] ..... G03C 1/09
(52) U.S. Cl. ..... 430/603; 430/599; 430/605
(58) Field of Search ..... 430/599, 603, 430/605

(56) References Cited

U.S. PATENT DOCUMENTS 4,435,501 A * 3/1984 Maskasky ..... 430/434
4,439,520 A * 3/1984 Kofron et al. ..... 430/434
5,759,760 A * 6/1998 Lushington et al. ..... 430/603

OTHER PUBLICATIONS

Kuge, et al., "Tracing the Conversion of Silver Sulfide in Gold–Thiourea Complex Solution by X–ray Diffraction," Journal of Imaging Science and Technology, vol. 36, No. 6, Nov./Dec. 1992.
"Photographic Silver Halide Emulsions, Preparations, Addenda, Processing and Systems," No. 17643, Research Disclosure, Dec. 1978.
"Dopant Sensitized Photographic Emulsions," No. 36736, Research Disclosure, Nov. 1994.

* cited by examiner

*Primary Examiner*—Hoa Van Le
(74) *Attorney, Agent, or Firm*—Sughrue Mion, PLLC

(57) ABSTRACT

Disclosed is a method for chemical sensitization of a silver halide emulsion comprising a sensitization step of subjecting the silver halide emulsion to chemical sensitization with a chalcogen compound or a chalcogen compound and a gold compound to produce silver chalcogenide or gold silver chalcogenide, wherein the chemical sensitization is performed under such conditions that at least a part of the silver chalcogenide or gold silver chalcogenide produced in the sensitization step can be amorphized. This method can provide a silver halide emulsion showing high sensitivity without increasing fog and degrading storability and such a silver halide emulsion.

17 Claims, No Drawings

SILVER HALIDE EMULSION AND METHOD FOR CHEMICAL SENSITIZATION THEREOF

TECHNICAL FIELD

The present invention belongs to the technical fields of silver halide photographic emulsion and method for chemical sensitization thereof, in particular, the technical fields of silver halide photographic emulsion of which sensitivity, fog and storability are improved by controlled chalcogen sensitization and method for chemical sensitization of such an emulsion.

RELATED ART

In silver halide photographic light-sensitive materials, silver halide emulsions subjected to chemical sensitization using various kinds of chemical substances are generally used in order to obtain desired sensitivity, gradation and so forth. As typical methods for that purpose, there are known various sensitization techniques including chalcogen sensitization such as sulfur sensitization, selenium sensitization and tellurium sensitization, noble metal sensitization such as gold sensitization, reduction sensitization using a reducing agent and so forth, which are used each alone or in combination. In recent years, the requirements for higher sensitivity, superior granularity, gradation or high sharpness, good storability, quick development with accelerated progress of development and so forth for silver halide photographic light-sensitive materials are increasingly become severer.

Among the aforementioned techniques, the chalcogen sensitization is a technique indispensable to high sensitivity silver halide photographic emulsions, and various researches have been conducted for many years aiming at further higher sensitivity. However, higher sensitivity invites, in particular, increase of fog, and long term storage always invites sensitivity fluctuation and increase of fog. Therefore, there have been strongly desired ameliorations of these problems. As for these problems, there has hitherto been attempted to solve them by addition of antifoggants or stabilizers, improvement of chalcogen sensitizers and so forth. However, these attempts have been made mainly on trial and error basis to provide improvements, and any universal technique has not been established. On the other hand, although noble metal sensitization that utilizes a transition metal for chemical sensitization is known for many years, any method of realizing effective action of chemical sensitization with a transition metal by combination with chalcogen sensitization has not been known at all.

SUMMARY OF THE INVENTION

The present invention was accomplished in view of all the aforementioned problems, and the first object of the present invention is to provide a silver halide emulsion showing high sensitivity and low fog. The second object of the present invention is to provide a silver halide emulsion showing superior storability. The third object of the present invention is to provide a method for chemical sensitization that provides a silver halide emulsion showing high sensitivity without degrading fog and storability.

In order to achieve the aforementioned objects, the inventor of the present invention paid attention to the relationship between crystallinity of silver chalcogenide or gold silver chalcogenide produced by chalcogen sensitization and characteristics of the obtained emulsion, and conducted various researches on the relationship. As a result, he found that, if at least a part of silver chalcogenide or gold silver chalcogenide produced by chalcogen sensitization is amorphous, an emulsion showing superior characteristics could be obtained, and accomplished the present invention based on this finding.

In order to achieve the aforementioned objects, the silver halide emulsion of the present invention is a silver halide emulsion containing silver chalcogenide or gold silver chalcogenide produced by chemical sensitization, wherein at least a part of the silver chalcogenide or gold silver chalcogenide is amorphous.

In the present invention, intensity of a maximum X-ray diffraction peak of the silver chalcogenide or gold silver chalcogenide is preferably ½ or less of intensity of a maximum X-ray diffraction peak of silver chalcogenide or gold silver chalcogenide that is not amorphized.

Further, in order to achieve the aforementioned objects, the method for chemical sensitization of a silver halide emulsion of the present invention is a method for chemical sensitization of a silver halide emulsion comprising a sensitization step of subjecting the silver halide emulsion to chemical sensitization with a chalcogen compound or a chalcogen compound and a gold compound to produce silver chalcogenide or gold silver chalcogenide, wherein the chemical sensitization is performed under such conditions that at least a part of the silver chalcogenide or gold silver chalcogenide produced in the sensitization step should be amorphized.

In the chemical sensitization method of the present invention, the chemical sensitization is preferably performed in the presence of transition metal ions of at least one metal selected from the metals of Group IB, Group IIB, Group VIA, Group VIIA and Group VIII. Further, in the chemical sensitization method of the present invention, the maximum X-ray diffraction peak intensity of silver chalcogenide or gold silver chalcogenide obtained for a standard model as defined in the following (a) (Intensity A) and the maximum X-ray diffraction peak intensity of silver chalcogenide or gold silver chalcogenide obtained by applying the chemical sensitization conditions of the chemical sensitization step to a simplified model as defined in the following (b) (Intensity B) preferably satisfy the relational equation defined in the following (c):

(a) silver chalcogenide or gold silver chalcogenide produced by mixing 20 mL of 0.01 mol/L silver nitrate aqueous solution, 20 mL of 0.01 mol/L solution of the chalcogen compound in water or an alcohol and, when a gold compound is also used in the chemical sensitization, 0.01 mol/L solution of the gold compound in water or an alcohol in such an amount that the gold compound and the chalcogen compound should exist in the same molar ratio as that used for the chemical sensitization at the temperature used for the chemical sensitization, (b) silver chalcogenide or gold silver chalcogenide produced by mixing the chalcogen compound or the chalcogen compound and the gold compound with 20 mL of 0.01 mol/L silver nitrate aqueous solution under the same conditions as those of the chemical sensitization, except that the silver halide emulsion does not exist, the chalcogen compound is added as 0.01 mol/L solution in water or an alcohol and the other additives are added in such amounts that molar ratios of the additives with respect to the chalcogen compound should be the same as those used for the chemical sensitization, (c) $B/A \leqq ½$.

According to the present invention, there can be provided a silver halide emulsion showing high sensitivity, low fog and superior storability. According to the present invention, there can also be provided a method for chemical sensitization of a silver halide emulsion, which provides a silver halide emulsion showing high sensitivity while obviating increase of fog and degradation of storability.

BEST MODE FOR CARRYING OUT THE INVENTION

The present invention will be explained in detail hereafter. In the following description, ranges indicated with "–" mean ranges including the numerical values before and after "–" as the minimum and maximum values.

The silver halide emulsion of the present invention contains silver chalcogenide or gold silver chalcogenide produced by chemical sensitization. It is sufficient that the silver halide emulsion of the present invention be chemically sensitized by using at least a chalcogen compound (henceforth referred to as "chalcogen sensitization"), and it may be chemically sensitized by a combination of chalcogen sensitization and another type of sensitization. As the other type of sensitization, gold sensitization is preferred. When chalcogen sensitization and gold sensitization are used in combination, gold silver chalcogenide is formed by chalcogen sensitization. The chalcogen sensitization include sulfur sensitization, selenium sensitization, tellurium sensitization and sensitization by a combination of two or more of them.

For the sulfur sensitization, labile sulfur compounds are used as sulfur sensitizers. For example, there can be used labile sulfur compounds described in P. Grafkides, Chimie et Physique Photographique, 5th Ed., Paul Montel, 1987, Research Disclosure, Vol. 307, No. 307105 and so forth. The labile sulfur compounds used herein are known sulfur compounds, for example, thiosulfates (e.g., hypo), thioureas (e.g., diphenyithiourea, triethylthiourea, N-ethyl-N'-(4-methyl-2-thiazolyl)thiourea, carboxymethyltrimethylthiourea), thioamides (e.g., thioacetamide), rhodanines (e.g., diethylrhodanine, 5-benzylidene-N-ethylrhodanine), phosphine sulfides (e.g., trimethyiphosphine sulfide), thiohydantoins, 4-oxo-oxazolidine-2-thiones, di- or poly-sulfides (e.g., dimorpholine disulfide, cysteine, hexathiocane-thione), mercapto compounds (e.g., cysteine), polythionates, elemental sulfur and so forth as well as active gelatin. Particularly preferred are thiosulfates, thioureas, phosphine sulfides and rhodanines.

For selenium sensitization, labile selenium compounds are used as selenium sensitizers. For example, there can be used selenium compounds disclosed in Japanese Patent Publication (Kokoku, referred to as JP-B hereinafter) No. 43-13489, JP-B-44-15748, Japanese Patent Laid-open Publication (Kokai, referred to as JP-A hereinafter) No. 4-25832, JP-A-4-109340, JP-A-4-271341, JP-A-5-40324, JP-A-5-11385, JP-A-6-051415, JP-A-6-175258, JP-A-6-180478, JP-A-6-208186, JP-A-6-208184, JP-A-6-317867, JP-A-7-092599, JP-A-7-098483, JP-A-07-140579 and so forth. Specifically, there can be used colloidal metal selenium, selenoureas (e.g., N,N-dimethylselenourea, trifluoromethylcarbonyltrimethylselenourea, acetyltrimethylselenourea), selenoamides (e.g., selenoamides, selenoacetamide, N,N-diethylphenylselenoamide), phosphine selenides (e.g., triphenylphosphine selenide, pentafluorophenyltriphenylphosphine selenide), selenophosphates (e.g., tri-p-tolylselenophosphate, tri-n-butylselenophosphate), seleno ketones (e.g., selenobenzophenone), isoselenocyanates, selenocarboxylic acids, seleno esters, diacyl selenides and so forth. In addition, non-labile selenium compounds disclosed in JP-B-46-4553 and JP-B-52-34492 such as selenious acid, selenocyanates (e.g., potassium selenocyanate), selenazoles and selenides can also be used. Particularly preferred are phosphine selenides, selenoureas, seleno esters and selenocyanates.

For the tellurium sensitization, labile tellurium compounds are used as tellurium sensitizers. For example, there can be used labile tellurium compounds described in JP-A-4-224595, JP-A-4-271341, JP-A-4-333043, JP-A-5-303157, JP-A-6-27573, JP-A-6-175258, JP-A-6-180478, JP-A-6-208186, JP-A-6-208184, JP-A-6-317867, JP-A-7-140579 and so forth. Specifically, there can be used phosphine tellurides (e.g., butyldiisopropylphosphine telluride, tributylphosphine telluride, ethoxydiphenylphosphine telluride), diacyl (di)tellurides (e.g., bis(diphenylcarbamoyl) ditelluride, bis (N-phenyl-N-methylcarbamoyl) ditelluride, bis (N-phenyl-N-methylcarbamoyl) telluride, bis(N-phenyl-N-benzylcarbamoyl) telluride, bis(ethoxycarbonyl) telluride, tellurureas (e.g., N,N'-dimethylethylenetellurourea, N,N-diphenylethylenetellurourea), telluroamides, telluro esters and so forth. Particularly preferred are diacyl (di)tellurides and phosphine tellurides.

When the aforementioned chalcogen sensitization is used in combination with gold sensitization, a silver halide emulsion can be made show higher sensitivity, lower fog and more improved storability.

As gold sensitizers, there can be used the gold salts described in P. Grafkides, Chimie et Physique Photographique (Paul Montel, 1987, 5th edition), Research Disclosure, vol. 307, No. 307105 and so forth.

Specifically, besides chloroauric acid, potassium chloroaurate and potassium auriothiocyanate, there can be used gold compounds described in U.S. Pat. No. 2,642,361 (gold sulfides, gold selenides etc.), U.S. Pat. No. 3,503,479 (gold thiolates having a water-soluble group etc.), U.S. Pat. No. 5,049,484 (bis(methylhydantoinate) gold complexes etc.), U.S. Pat. No. 5,049,485 (mesoionic thiolate gold complexes, e.g., 1,4,5-trimethyl-1,2,4-triazolium-3-thiolate gold complex etc.), U.S. Pat. Nos. 5,252,455 and 5,391,727 (large ring heterocyclic gold complexes), U.S. Pat. Nos. 5,620,481, 5,700,631, 5,759,760, 5,759,761, 5,912,111, 5,912,112, 5,939,245, JP-A-1-147537, JP-A-8-69074, JP-A-8-69075, JP-A-9-269554, JP-B-45-29274, German Patent Nos. DD-264524A, DD-264525A, DD-265474A, DD-298321A, JP-A-2001-75214, JP-A-2001-75215, JP-A-2001-75216, JP-A-2001-75217, JP-A-2001-75218 and so forth.

In the present invention, the silver halide emulsion is preferably chemically sensitized by a combination of gold sensitization and chalcogen sensitization selected from sulfur sensitization, selenium sensitization, tellurium sensitization, sulfur selenium sensitization, sulfur tellurium sensitization and sulfur selenium tellurium sensitization.

Although the preferred range of the amount of the chemical sensitizer used in the present invention may vary depending on the silver halide grains used, chemical sensitization conditions used and so forth, it is usually about $10^{-8}$ to $10^{-2}$ mol, preferably about $10^{-7}$ to $10^{-3}$ mol, per one mole of silver halide.

Although the conditions of the chemical sensitization are not particularly limited in the present invention, pAg is preferably 6–11, more preferably 7–10, and pH is preferably 4–10, more preferably 5–8. The temperature for the chemical sensitization is preferably 45–95° C., more preferably 45–85° C.

The silver halide emulsion of the present invention is characterized in that at least a part of the silver chalcogenide or gold silver chalcogenide produced on the silver halide is amorphous. Preferably, a half or more, more preferably ¾ or more, of the silver chalcogenide or gold silver chalcogenide is amorphous, and all the silver chalcogenide or gold silver chalcogenide may be amorphous. Whether the silver chalcogenide or the like produced by the chemical sensitization is amorphous or not can be usually confirmed by diffraction, particularly simply, by X-ray diffraction. X-Ray diffraction measured for crystalline silver chalcogenide or gold silver chalcogenide shows a maximum peak at a specific 2θ depending on its crystal system. On the other hand, X-ray diffraction of amorphous silver chalcogenide or gold silver chalcogenide does not show any peak peculiar to the crystal system. Therefore, amorphization of the produced silver chalcogenide or gold silver chalcogenide can be confirmed by measuring its X-ray diffraction and tracing intensity of a maximum peak peculiar to the corresponding crystal system, and a ratio of amorphized silver chalcogenide or gold silver chalcogenide can be estimated by calculating a reduction ratio of the peak intensity.

However, since the sensitization centers formed on the silver halide grains by the chemical sensitization (namely, silver chalcogenide or gold silver chalcogenide) actually have a small size or are formed in only a small amount, it is often difficult to determine whether the silver chalcogenide or gold silver chalcogenide has been amorphized or not by tracing the maximum peak intensity in X-ray diffraction as described above. In such a case, amorphization of silver chalcogenide or the like in an actual system can be determined by similarly performing the chemical sensitization in a model simplifying the system of interest and confirming reduction of X-ray diffraction peak intensity of the produced silver chalcogenide and gold silver chalcogenide.

As the method for determining whether the silver chalcogenide or the like produced by the chemical sensitization is amorphous or not using a simplified model based on X-ray diffraction, there can be mentioned a method of comparing intensity of a maximum X-ray diffraction peak obtained for silver chalcogenide or gold silver chalcogenide formed in a model that simplify the actual chemical sensitization with intensity of a maximum X-ray diffraction peak as a standard obtained for silver chalcogenide or gold silver chalcogenide formed by simply mixing a solution of a chalcogen sensitizer or a solution containing a chalcogen sensitizer and a gold sensitizer with a silver nitrate solution to know degree of the amorphization. Usually, if an aqueous solution containing a chalcogen compound used as a chalcogen sensitizer or an aqueous solution of a chalcogen compound used as a chalcogen sensitizer and a gold compound used as a gold sensitizer and an aqueous solution of silver nitrate are simply mixed, crystalline silver chalcogenide or gold silver chalcogenide is produced. Therefore, it can be presumed that the intensity of X-ray diffraction peak shown by the latter sample should correspond to intensity of a peak observed when the produced silver chalcogenide or gold silver chalcogenide is substantially 100% crystalline. On the other hand, as for the former sample, since at least a part of the produced silver chalcogenide or gold silver chalcogenide is amorphized, the intensity of X-ray diffraction peak shown by the former sample is reduced according to the ratio of amorphization. Therefore, by comparing the intensities of X-ray diffraction peaks of the former and the latter, the degree of amorphization of the produced silver chalcogenide or gold silver chalcogenide can be quantitatively determined, and thereby the degree of amorphization in the actual system can be presumed.

Specifically, degree of amorphization in an actual system can be presumed by comparing Intensity A of a maximum X-ray diffraction peak of silver chalcogenide or gold silver chalcogenide obtained for the following the standard model (a) with Intensity B of a maximum X-ray diffraction peak intensity of silver chalcogenide or gold silver chalcogenide obtained by applying the conditions of the actual chemical sensitization to a simplified model as defined in the following (b).

(a) silver chalcogenide or gold silver chalcogenide produced by mixing 20 mL of 0.01 mol/L silver nitrate aqueous solution, 20 mL of 0.01 mol/L solution of the chalcogen compound in water or an alcohol and, when a gold compound is also used in the chemical sensitization, 0.01 mol/L solution of the gold compound in water or an alcohol in such an amount that the gold compound and the chalcogen compound should exist in the same molar ratio as that used for the chemical sensitization at the temperature used for the chemical sensitization, (b) silver chalcogenide or gold silver chalcogenide produced by mixing the chalcogen compound or the chalcogen compound and the gold compound with 20 mL of 0.01 mol/L silver nitrate aqueous solution under the same conditions as those of the chemical sensitization, except that the silver halide emulsion does not exist, the chalcogen compound is added as 0.01 mol/L solution in water or an alcohol and the other additives are added in such amounts that molar ratios of the additives with respect to the chalcogen compound should be the same molar ratios as those used for the chemical sensitization.

In the standard model (a), the same chalcogen compound and gold compound as the chalcogen compound used as a chalcogen sensitizer and the gold compound used as a gold sensitizer in the simplified model (b) for comparison. As described above, when amorphization is determined for chemical sensitization also utilizing a gold compound, 0.01 mol/L solution of the gold compound in water or an alcohol is added in such an amount that the same molar ratio of the gold compound and the chalcogen compound as that used in the chemical sensitization should be obtained. Further, the chemical sensitization conditions used for the simplified model (b) are those affecting the amorphization, and include, for example, concentration ratio of the chalcogen compound and the gold compound, addition conditions of sensitizers (addition time, addition temperature etc.), use or disuse of addition of amorphizing agent, which will be described later, and addition conditions of the same (addition time, addition temperature etc.) and so forth. In the simplified model (b), although concentrations themselves of the sensitizer and other additives may differ from those of the chemical sensitization conditions of the actual system, concentration ratios (molar ratios) of the components (gold compound, amorphizing agent, other additives) with respect to the chalcogen compound should be the same as those of the chemical sensitization conditions. Further, the additives may be added at such addition time that relative addition time lags with respect to the addition of the chalcogen compound should be the same as those used as the chemical sensitization conditions. Furthermore, even when a gold compound is added before addition of a chalcogen compound in an actual chemical sensitization (e.g., a case where a gold salt other than gold silver chalcogenide deposits etc.), the gold compound may be added after the addition of the chalcogen compound. Further, various materials contained in a system in an actual sensitization process may be omitted in the simplified model (b), if the materials do not affect the amorphization of the silver chalcogenide or gold silver chalcogenide to be produced. In the standard model (a) and the simplified model (b), the solvent of the solution of chalcogen compound is a solvent containing water as a main component and prepared optionally with addition of an alcohol such as methanol depending on solubility of the sensitizer. On the other hand, the solvent of the solution of the gold compound is the same solvent as the solvent of the chalcogen compound in the standard model (a), and in the simplified model (b), when the kind of solvent affects the amorphization, the solvent used for the actual chemical sensitization is used.

As a specific example, an evaluation method used when irradiation of Ka ray of copper is used will be described. When a sulfur sensitizer is used, precipitates produced in the standard model (a) consist of monoclinic silver sulfide, and the maximum peak is observed for a (121) plane at $2\theta=34°$. When a selenium sensitizer is used, precipitates produced in the standard model (a) consist of monoclinic silver selenide, and the maximum peak is observed for a (121) plane at $2\theta=33°$. When a tellurium sensitizer is used, precipitates produced in the standard model (a) consist of cubic silver telluride, and the maximum peak is observed for a (501) plane at $2\theta=41°$. These are used as standards of diffraction peak of crystalline silver chalcogenide. Intensity of the same peak as the above can be measured for a sample chemically sensitized by using amorphization conditions in the simplified model (b) and compared with the standards mentioned above to confirm presence or absence of amorphization or quantitatively confirm degree of the amorphization.

As also for amorphization of chalcogen sensitization centers obtained by using gold sensitization in combination, degree of the amorphization can similarly be determined by, as described above, adding an aqueous solution of silver nitrate at the aforementioned concentration to a solution containing a chalcogen sensitizer, gold sensitizer and, e.g., amorphizing agent under the same conditions as those of the actual chemical sensitization, and measuring X-ray diffraction of the produced precipitates. Further, as also for amorphization of sulfur selenium sensitization centers, degree of the amorphization can similarly be determined by adding an aqueous solution of silver nitrate at the aforementioned concentration to a solution obtained by mixing a sulfur sensitizer and selenium sensitizer and adding, e.g., amorphizing agent under the same conditions as those of the actual chemical sensitization, and measuring X-ray diffraction of the produced precipitates. As for sulfur tellurium sensitization centers, sulfur selenium tellurium sensitization centers and those obtained by using any of these sensitizations with gold sensitization, amorphization can be determined similarly.

As for the silver halide emulsion of the present invention, the ratio of the maximum X-ray diffraction peak intensity of silver chalcogenide or gold silver chalcogenide obtained for the aforementioned simplified model (b), Intensity B, to the maximum X-ray diffraction peak intensity of silver chalcogenide or gold silver chalcogenide obtained for the aforementioned standard model (a), Intensity A, i.e., B/A, is preferably ½ or less, more preferably ¼ or less, particularly preferably ⅛ or less.

The silver halide emulsion of the present invention is prepared through a sensitization process in which the silver halide is sensitized with at least a chalcogen compound. Further, the silver halide emulsion of the present invention can be prepared with such conditions that at least a part of sensitization centers produced by the aforementioned sensitization process (namely, silver chalcogenide or gold silver chalcogenide) should be amorphized. The conditions for amorphizing the silver chalcogenide or the like used herein may be each of conditions including type of amorphizing agent, addition time (timing) of sensitizer and/or amorphizing agent, concentration ratio of the chalcogen sensitizer and amorphizing agent, reaction temperature during the chemical sensitization and a combination of these various conditions.

As the method for amorphizing the chalcogen sensitization centers or gold chalcogen sensitization centers produced during the sensitization process, there are (1) a method of attaining amorphozation by allowing incorporation of other atoms or molecules into the sensitization centers during the formation of the sensitization centers, and (2) a method of attaining amorphozation by allowing adsorption of other atoms or molecules around the sensitization centers during the formation of the sensitization centers. Specifically, there is a method of performing the sensitization in the presence of atoms or molecules having a property of being incorporated into or adsorbed around the sensitization centers. In particular, the sensitization is preferably performed in the presence of at least one transition metal ion selected from those of Group IB, Group IIB, Group VIA, Group VIIA and Group VIII metals. A compound containing atoms or the like having the aforementioned property can be added as an amorphizing agent simultaneously with the addition of a sensitizer or before or after addition of the sensitizer. The aforementioned amorphizing agent may be an inorganic compound or an organic compound. Preferred amorphizing agents include a compound containing Group VIII transition metal ion (the metal ion is preferably derived from Pt, Pd, Ir, Ru, Fe etc., more preferably derived from Pt, Pd or Ir, further preferably derived from Pt or Pd, most preferably derived from Pt), a compound containing Group IB transition metal ion (Cu compound etc.), a compound containing Group IIB transition metal ion (Zn compound etc.), a compound containing Group VIA transition metal ion (Cr compound etc.) and a compound containing Group VIIA transition metal ion (Mn compound, Re compound etc.). Among these, a compound of a group VIII metal is preferred. As the adsorptive compound used in the aforementioned method of (2), there can be mentioned compounds that are likely to adsorb to silver halide or silver chalcogenide.

Since the aforementioned amorphizing agent shows different amorphizing action with respect to silver chalcogenide and gold silver chalcogenide depending on its type, addition method, addition amount, addition time and so forth, suitable addition conditions and suitable material can be selected by tracing the X-ray diffraction peak mentioned above. That is, the amorphization conditions can be determined based on crystallinity of silver chalcogenide (or gold silver chalcogenide) produced after mixing silver nitrate and chalcogen sensitizer (and gold sensitizer) in a model, and chemical sensitization can be controlled by performing the chalcogen sensitization using those conditions. In general, the amount of the amorphizing agent is preferably $10^{-7}$ to $10^{-4}$ (molar ratio) with respect to silver halide, or preferably 1/16 to 16 times, more preferably ¼ to 4 times, in a molar ratio with respect to a chalcogen sensitizer. Further, addition time of the amorphizing agent is also an important parameter for the amorphization, and it is preferably added within 10 minutes before or after the addition of the chalcogen sensitizer, more preferably within 5 minutes before or after the addition of the chalcogen sensitizer, particularly preferably within 2 minutes before or after the addition of the chalcogen sensitizer. Furthermore, in order to realize amorphization more effectively by the chemical sensitization method of the present invention, preferred is an embodiment utilizing a combination of the type of amorphizing agent, addition amount of amorphizing agent, addition amounts of chalcogen sensitizer and gold sensitizer, ratio of these, addition time of these (especially, timing of addition of the chalcogen sensitizer and the amorphizing agent), temperature of chemical sensitization and other chemical sensitization conditions explained above as preferred embodiments.

Of course, it is also possible to obtain intensity of the maximum peak of X-ray diffraction within the range defined in present invention by controlling conditions other than the addition of amorphizing agent, and the means for it is not limited to the addition of an amorphizing agent. In addition, although it is known to add some of the aforementioned compounds mentioned above as amorphizing agents at the time of chemical sensitization, the present invention provides a novel sensitization method for chalcogen sensitization or gold chalcogen sensitization, which has never been known, because the method of the present invention is a control method in which the chemical sensitization is optimized based on variation of peak intensity of X-ray diffraction of silver chalcogenide or gold silver chalcogenide serving as sensitization centers and used for the utterly first time, in contrast to conventional techniques in which the compounds are just simply added.

In the present invention, reduction sensitization can also be used in combination. For reduction sensitization, the reducing compounds disclosed in P. Grafkides, Chimie et Physique Photographique (Paul Montel, 1987, 5th edition), Research Disclosure, vol. 307, No. 307105 and so forth can be used. Specifically, there can be used aminoiminomethane-sulfinic acid (also known as thiourea dioxide), borane compounds (e.g., dimethylaminoborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid) sulfites, aldehydes, hydrogen gas and so forth. Reduction sensitization may also be performed in an atmosphere of high pH or excess silver ion (so-called silver ripening). Although reduction sensitization may be performed at any time during the preparation of silver halide grains, it is particularly preferably performed during the formation of silver halide grains. In the present invention, it is preferable to use an oxidizing agent for silver. Examples thereof include thiosulfonates (e.g., sodium benzenethiosulfonate), disulfide compounds (e.g., bis(4-acetanilidephenyl) disulfide, lipoic acid), iodine, mercury salts an so forth, and thiosulfonates and disulfide compounds are particularly preferred.

In the present invention, the chemical sensitization of silver halide is preferably performed in the presence of a silver halide solvent.

Specific examples of the silver halide solvent include thiocyanates (e.g., potassium thiocyanate), thioether compounds (e.g., the compounds described in U.S. Pat. Nos. 3,021,215, 3,271,157, JP-B-58-30571, JP-A-60-136736, in particular, 3,6-dithia-1,8-octanediol etc.), tetra-substituted thiourea compounds (e.g., the compounds described in JP-B-59-11892 and U.S. Pat. No. 4,221,863, in particular, tetramethylthiourea), thione compounds described in JP-B-60-1134, mercapto compounds described in JP-B-63-29727, mesoionic compounds described in JP-A-60-163042, selenoether compounds described in U.S. Pat. No. 4,782,013, telluroether compounds described in JP-A-2-118566 and sulfites. Among these, thiocyanates, thioether compounds, tetra-substituted thiourea compounds, thione compounds and mesoionic compounds are preferred. The amount of the silver halide solvent used is approximately from $10^{-5}$ to $10^{-2}$ mol per mol of silver halide.

Hereafter, various materials usable for the silver halide emulsion of the present invention and a silver halide photographic light-sensitive material (in some cases, merely referred to as light-sensitive material) that can be produced by using the silver halide emulsion of the present invention will be explained.

For the silver halide emulsion of the present invention, any of silver bromide, silver iodobromide, silver iodochlorobromide, silver chlorobromide and silver chloride can be used. Silver halide grains may have a regular crystal form such as a cubic or octahedral form, an irregular crystal form such as a spherical or tabular form, or a form that is a composite of these crystal forms. Further, mixtures of grains having various crystal forms can be used, but grains having regular crystal forms are preferably used.

The silver halide grains used in the present invention as final grains may have a multi-layer structure comprising two or more layers different in the iodide composition between the inside and the surface layer of the grains (e.g., internal high iodide grains or surface high iodide grains). They may also be grains in which latent image is mainly formed on surfaces thereof (e.g., negative emulsion) or grains in which the latent image is mainly formed in the inside of the grains (e.g., internal latent image-type emulsion, preliminarily fogged direct reversal-type emulsion). However, grains in which the latent image is mainly formed on the surfaces are preferred. For the silver halide emulsion of the present invention, tabular silver halide grains are preferably used. The silver halide emulsion of the present invention preferably contains, as the final grain form, tabular silver halide grains having an aspect ratio of 2 or more, more preferably tabular silver halide grains having an average aspect ratio of 6 or more, particularly preferably 8 or more. The tabular grain preferably has a diameter of 0.15–5.0 $\mu$m (as a circle) and a thickness of 0.02–1.0 $\mu$m, more preferably 0.03–0.5 $\mu$m, particularly preferably 0.03–0.3 $\mu$m. The average aspect ratio is obtained as an arithmetic average of the aspect ratios of individual grains determined at least for 100 silver halide grains.

The tabular grains as final grains may have a (111) plane or (100) plane as a main plane. In the case where the final grains have a regular crystal form or spherical form or a steric form, the diameter thereof is preferably 0.05–3 $\mu$m, more preferably 0.08–2 $\mu$m, and an emulsion showing monodispersion with a coefficient of variation of preferably 30% or less, more preferably 20% or less, particularly preferably 15% or less, is preferred. The structure and the production method of the monodispersed tabular grains are described in, for example, JP-A-63-151618. However, to state the form briefly here, 70% or more of the entire projected area of silver halide grains is occupied by tabular silver halide grains having a hexagonal shape with a ratio of the length of a side having a maximum length to the length of a side having a minimum length being 2 or less and having two parallel planes as the outer surfaces, and the tabular grains are those showing monodispersion with a coefficient of variation [a value obtained by dividing the variation (standard deviation) of grain sizes represented by a diameter of a circle having the same area as the projected area of a grain with the average grain size] in the grain size distribution of the hexagonal tabular silver halide grains of 30% or less, preferably 20% or less, more preferably 15% or less.

In the present invention, the tabular grains as final grains preferably have dislocation lines. The dislocation lines of the tabular grain can be observed by a direct method using a transmission-type electron microscope at a low temperature as described in, for example, J. F. Hamilton, Phot. Sci. Eng., 11, 57 (1967) and T. Shiozawa, J. Soc. Phot. Sci. Japan, 35, 213 (1972). The dislocation lines may be blade-like dislocations or screw dislocations. Each grain preferably has at least 5 dislocation lines, more preferably 10 dislocation lines. Further, it preferably has a portion formed by epitaxial growth.

Further, during grain formation of the silver halide grains, there can be used a silver halide solvent for controlling the grain growth, for example, ammonia, potassium thiocyanate, ammonium thiocyanate, thioether compounds (e.g., those disclosed in U.S. Pat. Nos. 3,271,157, 3,574,628, 3,704,130, 4,297,439, 4,276,374), thione compounds (e.g., those disclosed in JP-A-53-144319, JP-A-53-82408, JP-A-55-77737) and amine compounds (e.g., those disclosed in JP-A-54-100717).

During the formation of silver halide grains or physical ripening thereof, a ruthenium salt (e.g., hexacyanoruthenium), zinc salt, chromium salt, iridium salt or complex salt thereof (e.g., iridium hexachloride, aquoiridium pentachloride, thiazole iridium pentachloride), rhodium salt or complex salt thereof (e.g., rhodium hexachloride, rhodium aquorhodium), or iron salt or iron complex salt (e.g., yellow prussiate of potash) may be present together. Among these, an iridium salt, iron salt and rhodium salt are preferred. A hexa-coordinate compound is particularly preferred.

The silver halide emulsion of the present invention preferably contains a hydrophilic polymer as a binder for forming a layer and/or protective colloid. Examples of the hydrophilic polymer include proteins such as gelatin derivatives, graft polymers of gelatin with other polymers, albumin and casein; saccharide derivatives such as cellulose derivatives (e.g., hydroxyethylcellulose, carboxymethylcellulose, cellulose sulfate), sodium alginate and starch derivatives; and various synthetic hydrophilic polymers including homopolymers and copolymers such as polyvinyl alcohol, polyvinyl alcohol partial acetal, poly-N-vinyl-pyrrolidone, polyacrylic acid, polymethacrylic acid, polyacrylamide, polyvinylimidazole or polyvinylpyrazole. Among the aforementioned hydrophilic polymers, gelatin is preferred. As gelatin, besides commonly used lime-treated gelatin, acid gelatin and acid-treated gelatin described in Bull. Soc. Phot. Japan, No. 16, p. 30, (1966) may also be used, and hydrolysate of gelatin can also be used.

The aforementioned hydrophilic polymer can be used not only for an emulsion layer but also for an intermediate layer of a photographic light-sensitive material.

The silver halide photographic emulsion of the present invention is preferably spectrally sensitized with a methine dye or others. Examples of the dye used include a cyanine dye, a merocyanine dye, a complex cyanine dye, a complex merocyanine dye, a holopolar cyanine dye, a hemicyanine dye, a styryl dye and a hemioxonol dye. Among these, preferred are dyes belonging to the cyanine dye, merocyanine dye or complex merocyanine dye. For these dyes, any nucleus commonly used for cyanine dyes as a basic heterocyclic nucleus can be used. Examples of the nucleus include pyrroline nucleus, oxazoline nucleus, thiazoline nucleus, pyrrol nucleus, oxazole nucleus, thiazole nucleus, selenazole nucleus, imidazole nucleus, tetrazole nucleus and pyridine nucleus; nuclei resulting from fusion of an alicyclic hydrocarbon ring to the aforementioned nuclei; and nuclei resulting from fusion of an aromatic hydrocarbon ring to the aforementioned nuclei, e.g., indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus, quinoline nucleus and so forth. These nuclei may have a substituent on a carbon atom. For the merocyanine dye or complex merocyanine dye, a 5- or 6-membered heterocyclic nucleus such as pyrazolin-5-one nucleus, thiohydantoin nucleus, 2-thiooxazolidine-2,4-dione nucleus, thiazolidine-2,4-dione nucleus, rhodanine nucleus and thiobarbituric acid nucleus may be used as a nucleus having a ketomethylene structure.

These sensitizing dyes may be used each alone or in combination. A combination of sensitizing dyes is often used for the purpose of supersensitization. Further, dyes that themselves do not have a spectral sensitization action or materials that substantially do not absorb visible light but show supersensitization can be incorporated into the emulsion together with sensitizing dyes. For example, substituted aminostilbene compounds substituted with a nitrogen-containing heterocyclic nucleus group (e.g., those disclosed in U.S. Pat. Nos. 2,933,390 and 3,635,721), aromatic organic acid-formaldehyde condensates (those disclosed in U.S. Pat. No. 3,743,510), cadmium salts or azaindene compounds and so forth may be contained in the emulsion. The combinations disclosed in U.S. Pat. Nos. 3,615,613, 3,615,641, 3,617,295 and 3,635,721 are particularly effective.

Various compounds can be added to the silver halide photographic emulsion of the present invention for preventing generation of fog, stabilizing photographic performances or the like during production or storage of the light-sensitive material. Such compounds include compounds known as antifoggants or stabilizers such as azoles, e.g., benzothiazolium salts, nitroimidazole salts, nitrobenzimidazoles, chlorobenzimidazoles, bromobenzimidazoles, mercaptothiazoles, mercaptobenzothiazoles, aminotriazoles, benzotriazoles, nitrobenzotriazoles, mercaptotetrazoles (in particular, 1-phenyl-5-mercaptotetrazoles); mercaptopyrimidines; mercaptotriazines; thioketo compounds, e.g., oxazolinethione; azaindenes, e.g., triazaindenes, tetrazaindenes (in particular, 4-hydroxy-6-methyl (1,3,3a,7)tetrazaindene), pentaazaindenes; benzenethiosulfinic acid, and benzenesulfonic acid amide.

The silver halide emulsion of the present invention (in particular, emulsion comprising tabular grains) can be prepared according to the methods disclosed in Cleve, Photography Theory and Practice, page 131 (1930); Gutoff, Photographic Science and Engineering, Vol. 14, pages 248 to 257 (1970), U.S. Pat. Nos. 4,434,226, 4,414,310, 4,433,048, 4,439,520, British Patent No. 2,112,157 and so forth.

A silver halide photographic light-sensitive material can be produced by using the silver halide emulsion of the present invention. The light-sensitive material has a photosensitive layer containing the silver halide emulsion of the present invention on a support, for example. In addition to the aforementioned photosensitive layer, it may have a back layer, intermediate layer, protective layer and so forth, and it may have two or more photosensitive layers.

The photographic light-sensitive material may contain an inorganic or organic hardening agent in any hydrophilic colloid layer constituting the photographic light-sensitive layer or back layer. Specific examples thereof include chromium salts, aldehyde salts (e.g., formaldehyde, glyoxal, glutaraldehyde) and N-methylol type compounds (e.g., dimethylolurea). Further, active halogen compounds (e.g., 2,4-dichloro-6-hydroxy-1,3,5-triazine and a sodium salt thereof) and active vinyl compounds (e.g., 1,3-bisvinylsulfonyl-2-propanol, 1,2-bis(vinylsulfonylacetamide)ethane, bis(vinylsulfonylmethyl) ether, vinyl polymers having a vinylsulfonyl group on side chains thereof) are preferred because they can rapidly harden the hydrophilic colloid such as gelatin to provide stable photographic properties. Furthermore, N-carbamoylpyridinium salts (e.g., (1-morpholinocarbonyl-3-pyridinio)methanesulfonate) and haloamidinium salts (e.g., 1- (1-chloro-1-pyridinomethylene)pyrrolidinium-2-naphthalenesulfonate) also have a superior effect of realizing rapid hardening.

The light-sensitive material may contain one or more surface active agents for various purposes, for example, as a coating aid or antistatic agent or for improving lubricity, emulsion dispersion, preventing adhesion, improving photographic properties (e.g., development acceleration, increase of contrast, sensitization) and so forth in the same layer as the aforementioned silver halide emulsion layer or another layer.

The light-sensitive material may have a hydrophilic colloid layer for preventing irradiation or halation. A water-soluble dye can be added to the hydrophilic colloid layer as a filter dye. Preferred examples of such a dye include oxonol dyes, hemioxonol dyes, styryl dyes, merocyanine dyes, anthraquinone dyes and azo dyes. Other than these dyes, cyanine dyes, azomethine dyes, triarylmethane dyes and phthalocyanine dyes are also useful. It is also possible to emulsify an oil-soluble dye by the oil-in-water dispersion method and add it to the hydrophilic colloid layer.

The light-sensitive material may be constructed as a multi-layer multicolor photographic light-sensitive material having at least two different spectral sensitivities on a support.

Such a multi-layer natural color photographic material usually has at least one red-sensitive emulsion layer, at least one green-sensitive emulsion layer and at least one blue-sensitive emulsion layer on the support. The arrangement order of these layers may be freely selected according to the purpose. Preferred arrangements include the order of a red-sensitive layer, a green-sensitive layer and a blue-sensitive layer from the support side, the order of a blue-sensitive layer, a green-sensitive layer and a red-sensitive layer from the support side, and the order of a blue-sensitive layer, a red-sensitive layer and a green-sensitive layer from the support side. Further, any emulsion layer having the same color sensitivity may be constituted by two or more emulsion layers different in the sensitivity to increase the ultimate sensitivity. A three-layer structure may also be used to further improve the graininess. Furthermore, an emulsion layer having different color sensitivity may be interposed between the emulsion layers having the same color sensitivity. Still further, a reflection layer containing fine grain silver halide or the like may be provided under a high sensitivity layer, in particular, under a high sensitivity blue-sensitive layer, to increase the sensitivity.

The additives used in the silver halide emulsion of the present invention are described in Research Disclosure, Nos. 17643, 18716 and 307105, and the pertinent portions are summarized in the table mentioned below.

| Type of Additive | RD 17643 December 1978 | RD 18716 November 1979 | RD 307105 November 1989 |
|---|---|---|---|
| 1. Chemical sensitizer | p. 23 | p. 648, right column | p. 866 |
| 2. Sensitivity enhancing agent | | p. 648, right column | |
| 3. Spectral sensitizer and supersensitizer | pp. 23–24 | p. 648, right column to p. 649, right column | pp. 866–868 |
| 4. Brightening agent | p. 24 | pp. 647, right column | p. 868 |
| 5. Antifoggant and stabilizer | pp. 24–25 | p. 649, right column | pp. 868–870 |
| 6. Light absorber, filter dye and infrared absorber | pp. 25–26 | p. 649, right column to p. 650, left column | p. 873 |
| 7. Anti-staining agent | p. 25, right column | p. 650, left column to right column | p. 872 |
| 8. Dye image stabilizer | p. 25 | p. 650, left column | p. 872 |
| 9. Hardening agent | p. 26 | p. 651, left column | pp. 874–875 |
| 10. Binder | p. 26 | p. 651, left column | pp. 873–874 |
| 11. Plasticizer and lubricant | p. 27 | p. 650, right column | p. 876 |
| 12. Coating aid and surfactant | pp. 26–27 | p. 650, right column | pp. 875–876 |
| 13. Antistatic agent | p. 27 | p. 650, right column | pp. 876–877 |
| 14. Matting agents | | | pp. 878–879 |

Other techniques and inorganic or organic materials which can be used in the photographic light-sensitive material of the present invention are described in the following portions of European Unexamined Patent Publication No. 436938A2 or in the patents mentioned below.

Layer structure: from p. 146, line 34 to p. 147, line 25

Yellow coupler: from p. 137, line 35 to p. 146, line 33, and p. 149, lines 21 to 23

Magenta coupler: from p. 149, lines 24 to 28: and from p. 3, line 5 to p. 25, line 55 of European Unexamined Patent Publication No. 421453A1

Cyan coupler: from p. 149, lines 29 to 33; and from p. 3, line 28 to p. 40, line 2 of European Unexamined Patent Publication No. 432804A2

Polymer coupler: p. 149, lines 34 to 38; and from p. 113, line 39 to p. 123, line 37 of European Unexamined Patent Publication No. 435334A2

Colored coupler: from p. 53, line 42 to p. 137, line 34, and p. 149, lines 39 to 45

Other functional couplers: from p. 7, line 1 to p. 53, line 41, and p. 149, line 46 to p. 150, line 3; and from p. 3, line 1 to p. 29, line 50 of European Unexamined Patent Publication No. 435334A2

Antiseptic and insecticide: p. 150, lines 25 to 28

Formalin scavenger: p. 149, lines 15 to 17

Other additives: p. 153, lines 38 to 47; and from p. 75, line 21 to p. 84, line 56, and from p. 27, line 40 to p. 37, line 40 of European Unexamined Patent Publication No. 421453A1

Dispersion method: p. 150, lines 4 to 24

Support: p. 150, lines 32 to 34

Thickness and physical properties of layers: p. 150, lines 35 to 49

Color development process: p. 150, line 50 to p. 151, line 47

Desilvering process: p. 151, line 48 to p. 152, line 53

Automatic developing machine: p. 152, line 54 to p. 153, line 2

Water washing and stabilization processes: p. 153, lines 3 to 37

The present invention can be applied to various color or black-and-white photographic materials. Representative examples thereof include color negative film for general purpose or movies, color reversal film for slide or television, color paper, color positive film and color reversal paper, a color diffusion transfer type photosensitive material and a color photothermographic material. By using a tricolor coupler mixture described in Research Disclosure, No. 17123 (July, 1978) or a black color-forming coupler described in U.S. Pat. No. 4,126,461 and British Patent No. 2,102,136, the present invention can be applied also to a black-and-white photographic material such as X-ray film. Further, the present invention can be applied to film for platemaking such as lith film or scanner film, X-ray film for direct or indirect medical use or industrial use, negative black-and-white film for photographing, black-and-white printing paper, microfilm for COM or general use, a silver salt diffusion transfer type photosensitive material or a print-out type photosensitive material.

Preferred embodiments of the present invention are mentioned below.

(1) A silver halide emulsion containing silver chalcogenide or gold silver chalcogenide produced by chemical sensitization, wherein at least a part of the silver chalcogenide or gold silver chalcogenide is amorphous.

(2) The silver halide emulsion according to (1), wherein intensity of a maximum X-ray diffraction peak of the silver chalcogenide or gold silver chalcogenide is ½ or less of intensity of a maximum X-ray diffraction peak of silver chalcogenide or gold silver chalcogenide that is not amorphized.

(3) A silver halide emulsion according to (1) or (2), wherein a maximum X-ray diffraction peak intensity of silver chalcogenide or gold silver chalcogenide obtained by applying the conditions of the chemical sensitization to a simplified model as defined in the following (b) (Intensity B) and a maximum X-ray diffraction peak intensity of silver chalcogenide or gold silver chalcogenide obtained for a standard model as defined in the following (a) (Intensity A) satisfy the relational equation defined in the following (c):

(a) silver chalcogenide or gold silver chalcogenide produced by mixing 20 mL of 0.01 mol/L silver nitrate aqueous solution, 20 mL of 0.01 mol/L solution of the chalcogen compound in water or an alcohol and, when a gold compound is also used in the chemical sensitization, 0.01 mol/L solution of the gold compound in water or an alcohol in such an amount that the gold compound and the chalcogen compound should exist in the same molar ratio as that used for the chemical sensitization at the temperature used for the chemical sensitization, (b) silver chalcogenide or gold silver chalcogenide produced by mixing the chalcogen compound or the chalcogen compound and the gold compound with 20 mL of 0.01 mol/L silver nitrate aqueous solution under the same conditions as those of the chemical sensitization, except that the silver halide emulsion does not exist, the chalcogen compound is added as 0.01 mol/L solution in water or an alcohol and the other additives are added in such amounts that molar ratios of the additives with respect to the chalcogen compound should be the same molar ratios as those used for the chemical sensitization, (c) $B/A \leqq ½$.

(4) A method for chemical sensitization of a silver halide emulsion comprising a sensitization step of subjecting the silver halide emulsion to chemical sensitization with a chalcogen compound or a chalcogen compound and a gold compound to produce silver chalcogenide or gold silver chalcogenide, wherein the chemical sensitization is performed under such conditions that at least a part of the silver chalcogenide or gold silver chalcogenide produced in the sensitization step should be amorphized.

(5) The method for chemical sensitization of a silver halide emulsion according to (4), wherein an amorphizing agent is used in the sensitization step.

(6) The method for chemical sensitization of a silver halide emulsion according to (4) or (5), wherein the chemical sensitization is performed in the presence of transition metal ions of at least one metal selected from the metals of Group IB, Group IIB, Group VIA, Group VIIA and Group VIII.

(7) The method for chemical sensitization of a silver halide emulsion according to any one of (4) to (6), wherein a maximum X-ray diffraction peak intensity of silver chalcogenide or gold silver chalcogenide obtained for a standard model as defined in the following (a) (Intensity A) and a maximum X-ray diffraction peak intensity of silver chalcogenide or gold silver chalcogenide obtained by applying the chemical sensitization conditions of the sensitization step to a simplified model as defined in the following (b) (Intensity B) satisfy the relational equation defined in the following (c):

(a) silver chalcogenide or gold silver chalcogenide produced by mixing 20 mL of 0.01 mol/L silver nitrate aqueous solution, 20 mL of 0.01 mol/L solution of the chalcogen compound in water or an alcohol and, when a gold compound is also used in the chemical sensitization, 0.01 mol/L solution of the gold compound in water or an alcohol in such an amount that the gold compound and the chalcogen compound should exist in the same molar ratio as that used for the chemical sensitization at the temperature used for the chemical sensitization, (b) silver chalcogenide or gold silver chalcogenide produced by mixing the chalcogen compound or the chalcogen compound and the gold compound with 20 mL of 0.01 mol/L silver nitrate aqueous solution under the same conditions as those of the chemical sensitization, except that the silver halide emulsion does not exist, the chalcogen compound is added as 0.01 mol/L solution in water or an alcohol and the other additives are added in such amounts that molar ratios of the additives with respect to the chalcogen compound should be the same molar ratios as those used for the chemical sensitization, (c) $B/A \leqq ½$.

(8) The silver halide emulsion according to any one of (1) to (3) or the method for chemical sensitization of an silver halide emulsion according to any one of (4) to (7), wherein a gold sensitizer (especially a gold sensitizer having an organic ligand) is used in the sensitization step.

(9) The silver halide emulsion or the method for chemical sensitization of a silver halide emulsion according to any one of the aforementioned embodiments, wherein reduction sensitization is used in combination in the sensitization step, especially during formation of silver halide grains.

(10) The silver halide emulsion or the method for chemical sensitization of a silver halide emulsion according to any one of the aforementioned embodiments, wherein a sensitizing dye (preferably amelocyanine dye or cyanine dye, particularly preferably a cyanine dye) is added during the sensitization step or before or after the sensitization step.

(11) The silver halide emulsion or the method for chemical sensitization of a silver halide emulsion according to any one of the aforementioned embodiments, wherein a nitrogen-containing heterocyclic compound, especially a heterocyclic compound containing two or more nitrogen atoms, is added during the sensitization step.

(12) The silver halide emulsion or the method for chemical sensitization of a silver halide emulsion according to any one of the aforementioned embodiments, wherein the silver halide grains are tabular grains having an aspect ratio of 2 or more, preferably 6 or more, particularly preferably 8 or more.

(13) The silver halide emulsion or the method for chemical sensitization of a silver halide emulsion according to any one of the aforementioned embodiments, wherein the tabular grains mentioned in (12) have a (111) plane as a main plane.

(14) The silver halide emulsion or the method for chemical sensitization of a silver halide emulsion according to any one of the aforementioned embodiments, wherein the tabular grains mentioned in (12) have a (100) plane as a main plane.

(15) The silver halide emulsion or the method for chemical sensitization of a silver halide emulsion according to any one of the aforementioned embodiments, wherein the silver halide grains have dislocation lines, in particular, 5 or more lines per one grain.

(16) The silver halide emulsion or the method for chemical sensitization of a silver halide emulsion according to any one of the aforementioned embodiments, wherein the silver halide grains have a portion formed by epitaxial growth.

(17) The silver halide emulsion or the method for chemical sensitization of a silver halide emulsion according to any one of the aforementioned embodiments, wherein the silver halide grains have a coefficient of variation of 30% or less, preferably 20% or less, particularly preferably 15% or less, for the grain size.

(18) The silver halide emulsion or the method for chemical sensitization of a silver halide emulsion according to any one of the aforementioned embodiments, wherein the silver halide grains contain a Group VIII metal (e.g., Fe, Ir, Ru, Rh, Os etc.) or an inorganic or organic hexacoordinate complex thereof.

(19) The silver halide emulsion or the method for chemical sensitization of a silver halide emulsion according to any one of the aforementioned embodiments, which contains at least one of the compounds disclosed in U.S. Pat. Nos. 5,413,905, 5,482,825, 5,747,235, 5,747,236, 5,994,051 and 6,054,260.

(20) The silver halide emulsion or the method for chemical sensitization of a silver halide emulsion according to any one of the aforementioned embodiments, wherein a compound of Group VIII metal (especially Pt) is added as an amorphizing agent within 5 minute before or after addition of the chalcogen compound in an amount of 1/16 to 16 times the amount of the chalcogen compound.

(21) The silver halide emulsion or method for chemical sensitization of a silver halide emulsion according to any one of the aforementioned embodiments, wherein a compound of Group VIII metal (especially Pt) is added as an amorphizing agent within 2 minute before or after addition of the chalcogen compound in an amount of ¼ to 4 times the amount of the chalcogen compound.

(22) A silver halide photographic light-sensitive material containing any one of the aforementioned silver halide emulsions.

EXAMPLES

The present invention will be specifically explained with reference to the following examples. The materials, regents, ratios, procedures and so forth mentioned in the following examples can be optionally changed so long as such change does not depart from the spirit of the present invention. Therefore, the scope of the present invention is not limited by the following examples.

Example 1

Silver iodobromide tabular grains were prepared by the same method as JP-A-10-239787, Example 2.

Specifically, 1.0 L of water and 2 g of low molecular weight ossein gelatin (average molecular weight: 110,000) were added to a reaction vessel and dissolved, and the solution was maintained at 35° C. Subsequently, 50 ml of 0.6 mol/L silver nitrate aqueous solution and 200 ml of 0.16 mol/L KBr aqueous solution containing 0.8 weight % of low molecular weight gelatin were added to a mixing machine over 2 minutes. The resulting emulsion was continuously added to the reaction vessel over 2 minutes. The mixing machine disclosed in JP-A-10-239787 was used as the mixing machine, and the rotation speed of stirring was 2,000 rpm.

In an amount of 300 ml of a solution containing 10% ossein gelatin in which 95% of amino groups were phthalated and KBr were added to the reaction vessel and pBr of the emulsion in the reaction vessel was adjusted to 2.1. Then, the temperature was elevated to 75° C., and the emulsion was left standing for 5 minutes (Ripening).

Subsequently, 600 ml of 1.0 mol/L silver nitrate aqueous solution, 600 ml of 0.99 mol/L KBr aqueous solution containing 3 mol % of KI and 800 ml of an aqueous gelatin solution containing 5% of low molecular weight gelatin were added to the mixing machine at an accelerated flow rate so that the final flow rate could be 4 times the initial flow rate. The rotation speed of stirring for this operation was 6,000 rpm. Fine grain emulsion formed in the mixing machine was continuously added to the reaction vessel.

During grain growth, $8\times10^{-8}$ mol/mol Ag of $IrCl_6$ was doped when 70% of silver nitrate was added. Further, a solution of yellow prussiate of potash was added to the mixing machine before completion of grain growth. Yellow prussiate of potash was doped so that its concentration could become $3\times10^{-4}$ mol/mol Ag as a local concentration for 3% (in terms of added silver amount) of the shell part of the grain. After completion of the addition, the temperature of the emulsion was lowered to 35° C., the emulsion was washed with water by an ordinary flocculation method, 70 g of lime-processed ossein gelatin was added and dissolved, pAg and pH were adjusted to 8.7 and 6.5, respectively, and the emulsion was stored at cool and dark place. The resulting tabular grains had a mean thickness of 0.042 $\mu$m, mean diameter of 1.30 $\mu$m as circle and variation coefficient of 18% for mean diameter.

One of divided portions of the above emulsion was warmed to 54° C., then added with chloroauric acid (1.8×

$10^{-5}$ mol/mol Ag), potassium thiocyanate ($3\times10^{-3}$ mol/mol Ag), a sulfur sensitizer, sodium thiosulfate ($2.4\times10^{-5}$ mol/mol Ag), and a selenium sensitizer, pentafluorophenyl-diphenyl-phosphine selenide ($1.2\times10^{-5}$ mol/mol Ag), ripened for 120 minutes, and added with Compound 1 (4-carboxyphenyl-5-mercaptotetrazole Na salt, $9\times10^{-4}$ mol/mol Ag) to obtain Emulsion A (comparative example for chalcogen sensitization).

Further, one of the divided portion of the above emulsion was warmed to 54° C., then added with chloroauric acid ($1.8\times10^{-5}$ mol/mol Ag), potassium thiocyanate ($3\times10^{-3}$ mol/mol Ag) and potassium chloroplatinate(II) ($1\times10^{-6}$ mol/mol Ag) as an amorphizing agent, and further added with a sulfur sensitizer, sodium thiosulfate ($2.4\times10^{-5}$ mol/mol Ag), and a selenium sensitizer, pentafluorophenyl-diphenyl-phosphine selenide ($1.2\times10^{-5}$ mol/mol Ag), ripened for 120 minutes, and added with Compound 1 (4-carboxyphenyl-5-mercaptotetrazole Na salt, $9\times10^{-4}$ mol/mol Ag) to obtain Emulsion B (Invention).

Emulsion C (Invention) was obtained from one of divided portions of the above emulsion in the same manner as that for Emulsion B except that the concentration of the chloroplatinate was changed to $4\times10^{-6}$ mol/mol Ag.

Emulsion D (Invention) was obtained from one of the divided portions of the above emulsion in the same manner as that for Emulsion B except that the concentration of the chloroplatinate was changed to 1.6×10 mol/mol Ag.

Emulsion E (Invention) was obtained from one of the divided portions of the above emulsion in the same manner as that for Emulsion B except that the concentration of the chloroplatinate was changed to $6.4\times10^{-5}$ mol/mol Ag.

Emulsion E was obtained from one of the divided portions of the above emulsion in the same manner as that for Emulsion A except that the chloroplatinate was added at a concentration of $6.4\times10^{-5}$ mol/mol Ag during the end period of the ripening.

Each of Emulsions A to E was added with (anhydro-5-chloro-5'-phenyl-9-ethyl-3,3'-di(3-sulfopropyl) benzoxacarbocyanine hydroxide sodium salt) as a sensitizing dye, 3-{3-[2-(2,4-di-tert-amylphenoxy)butylamino] benzoyl-amino}-1-(2,4,6-trichlorophenyl)pyrazolon-5-one as a magenta coupler, tricresyl phosphate as oil, 4-hydroxy-6-methyl-1,3,3a,7-tetrazaindene as a stabilizer, 1-(m-sulfophenyl)-5-mercaptotetrazole monosodium salt and 1-(p-carboxyphenyl)-5-mercaptotetrazole as antifoggants, sodium dodecylbenzenesulfonate as a coating aid, 1,2-bis (vinyl-sulfonylacetylamino)ethane as a hardening agent and phenoxyethanol as a preservative, and coated simultaneously with a gelatin protective layer containing polymethyl methacrylate particles on a triacetyl cellulose film support having an undercoat layer by the co-extrusion method to produce each of Samples 1 to 5.

Samples 1 to 5 were exposed (1/1000 second) through an optical wedge and subjected to the following development treatment.

(Development method)

| Step | Processing time | Processing temperature |
|---|---|---|
| Color development | 2 minutes and 15 seconds | 38° C. |
| Bleaching | 6 minutes and 30 seconds | 38° C. |
| Rinsing | 2 minutes and 10 seconds | 24° C. |

| (Fixer) | (Unit: g) |
|---|---|
| Ethylenediaminetetraacetic acid disodium salt | 0.5 |
| Sodium sulfite | 7.0 |
| Sodium hydrogensulfite | 5.0 |
| Ammonium thiosulfate aqueous solution (70%) | 170.0 ml |
| Water to make 1.0 L | |
| pH 6.7 | |

| (Stabilizer) | (Unit g) |
|---|---|
| Formalin (37%) | 2.0 ml |
| Polyoxyethylene p-monononylphenyl ether (average polymerization degree: 10) | 0.3 |
| Ethylenediaminetetraacetic acid disodium salt | 0.05 |
| Water to make 1.0 L | |
| pH 5.0–8.0 | |

Densities of the developed Samples 1 to 5 were measured. The obtained results for the photographic properties are shown in Table 1. The relative sensitivity was represented with a relative value of reciprocal of exposure required for obtaining an optical density of fog value +0.2 based on that value of Sample 1, which was taken as 100.

Further, X-ray diffraction was measured by the method described above (method utilizing the standard model (a) and the simplified model (b)). When potassium chloroplatinate(II) as an amorphizing agent was not added, the maximum peak was observed at 2θ=34°, and the intensity of that was taken as 100. Furthermore, the peak intensity was measured when the amorphizing agent was used, and its relative value with respect to the peak intensity obtained without the amorphizing agent was obtained. As for Sample 5 mentioned in Table 1, 60 minutes after the production of precipitates, potassium chloplatinate(II) was added and X-ray diffraction was measured.

TABLE 1

| Sample | Emulsion | Amount of amorphizing agent (μmol/mol Ag) | Addition time of amorphizing agent | Relative intensity of maximum X-ray diffraction peak | Fog | Relative sensitivity | Note |
|---|---|---|---|---|---|---|---|
| 1 | A | None | — | 100 | 0.025 | 100 | Comparative Example 1 |
| 2 | B | 4 | Added simultaneously with sensitizer | 100 | 0.020 | 100 | Comparative Example 2 |

TABLE 1-continued

| Sample | Emulsion | Amount of amorphizing agent (μmol/mol Ag) | Addition time of amorphizing agent | Relative intensity of maximum X-ray diffraction peak | Fog | Relative sensitivity | Note |
|---|---|---|---|---|---|---|---|
| 3 | C | 16 | Added simultaneously with sensitizer | 20 | 0.015 | 110 | Invention |
| 4 | D | 64 | Added simultaneously with sensitizer | 0 | 0.010 | 105 | Invention |
| 5 | E | 64 | Added 60 minutes after addition of sensitizer | 100 | 0.025 | 100 | Comparative Example 3 |

As clearly seen from the results shown in Table 1, when chalcogen sensitization was performed under such conditions that silver chalcogenide should be amorphized, increase of toe sensitivity and reduction of fog were favorably observed.

Example 2

Samples 1 to 5 of Example 1 were stored for three days under an atmosphere at a temperature of 50° C. and relative humidity of 80%, and then they were exposed and developed in the same manner as in Example 1 to evaluate fog with time.

TABLE 2

| Sample | Relative sensitivity | Fog with time | Note |
|---|---|---|---|
| 1 | 100 | 2.0 | Comparative Example 1 |
| 2 | 100 | 2.0 | Comparative Example 2 |
| 3 | 110 | 0.5 | Invention |
| 4 | 105 | 0.2 | Invention |
| 5 | 100 | 2.0 | Comparative Example 3 |

As seen from the results shown in Table 2, when chalcogen sensitization was performed under such conditions that silver chalcogenide should be amorphized, fog with time was favorably reduced.

Example 3

The same method as that of JP-A-10-239787, Example 1 was repeated provided that stirring was performed at a rotation speed of 3,000 rpm in the mixing machine. Specifically, 1.0 L of water, 3 g of low molecular weight ossein gelatin (average molecular weight: 20,000) and 0.5 g of KBr were added to a reaction vessel and dissolved. To the solution maintained at 40° C., 10 ml of 0.5 mol/L silver nitrate aqueous solution and 20 ml of 0.3 mol/L KBr solution were added with stirring over 40 seconds. Subsequently, the solution was added with 22 ml of 0.8 ml/L KBr solution. Then, the temperature was elevated to 75° C. and the mixture was ripened for 5 minutes. The mixture was added with 10 weight % aqueous solution containing oxidized ossein gelatin (methionine content: 5 μmol/g). Subsequently, 1,000 ml of 0.53 mol/L silver nitrate solution and 1,000 ml of 0.54 ml/L KBr solution containing 5 weight % of low molecular weight gelatin (average molecular weight: 20,000) were added to the mixing machine over 60 minutes. The formed fine grain emulsion was continuously added from the mixing machine to the reaction vessel. At that time, the temperature was maintained at 75° C. After completion of the addition, the temperature of the emulsion was lowered to 35° C., the emulsion was washed with water by an ordinary flocculation method, 70 g of lime-processed ossein gelatin was added and dissolved, and pAg and pH were adjusted to 8.7 and 6.5, respectively. The resulting tabular grains had a mean thickness of 0.05 μm, mean diameter of 1.52 μm as circle and variation coefficient of 19% for mean diameter.

One of divided portion of the above emulsion was added with, at 40° C., $1.6\times10^{-3}$ mol/mol Ag of Dye 1: {5,5'-diphenyl-N,N'-sufobutyl-monomethineoxacyanine Na salt}, then added with potassium thiocyanate ($2.0\times10^{-3}$ mol/mol Ag), chloroauric acid ($2\times10^{-5}$ mol/mol Ag), a sulfur sensitizer, sodium thiosulfate ($2.8\times10^{-5}$ mol/mol Ag), a selenium sensitizer, methoxyphenylselenocarboxy-2,2-dimethoxycyclohexane ester ($0.8\times10^{-6}$ mol/mol Ag), and a tellurium sensitizer, bis(N-phenyl-N-methylcarbamoyl) telluride ($0.4\times10^{-6}$ mol/mol Ag), and ripened for 80 minutes to obtain Emulsion F.

Further, Emulsion G was obtained from one of divided portions of the above emulsion in the same manner as that for Emulsion F except that potassium chloropalladate(IV) was added ($0.4\times10^{-6}$ mol/mol Ag) after chloroauric acid was added.

Emulsion H (Invention) was obtained from one of the divided portions of the above emulsion in the same manner as that for Emulsion G except that potassium chloropalladate (IV) was added at a concentration of $1.6\times10^{-5}$ mol/mol Ag.

Emulsion I (Invention) was obtained from one of the divided portions of the above emulsion in the same manner as that for Emulsion G except that potassium chloropalladate (IV) was added at a concentration of $6.4\times10^{-5}$ mol/mol Ag.

Emulsion J was obtained from one of the divided portions of the above emulsion in the same manner as that for Emulsion F except that potassium chloropalladate(IV) was added at a concentration of $6.4\times10^{-5}$ mol/mol Ag during the end period of the ripening.

Samples 6 to 10 were prepared by using the resulting Emulsions F to J, respectively, in the same manner as in Example 1 (provided that the sensitizing dye was not added and a yellow coupler was used instead of the magenta coupler), and evaluated similarly. The results are shown in Table 3. Further, results concerning fog with time were also obtained in the same manner as in Example 2. As for the relative sensitivity, the value of Sample 8 was taken as 100. Furthermore, amorphization was also determined by the method described above.

Further, X-ray diffraction was measured by the method described above. When potassium chloropalladate(IV) as an amorphizing agent was not added, the maximum peak was observed at 2θ=34°, and the intensity of that was taken as 100. Furthermore, the peak intensity was measured for the cases where the amorphizing agent was used, and relative values with respect to the peak intensity obtained without the amorphizing agent were obtained. As for Sample 10 mentioned in Table 3, 60 minutes after the production of precipitates, potassium chlopalladate(II) was added, and X-ray diffraction was measured.

TABLE 3

| Sample | Emulsion | Amount of amorphizing agent (μmol/mol Ag) | Addition time of amorphizing agent | Relative intensity of maximum X-ray diffraction peak | Fog | Relative sensitivity | Fog with time | Note |
|---|---|---|---|---|---|---|---|---|
| 6 | F | None | — | 100 | 0.023 | 100 | 2.2 | Comparative Example 1 |
| 7 | G | 4 | Added simultaneously with sensitizer | 90 | 0.021 | 100 | 2.1 | Comparative Example 2 |
| 8 | H | 16 | Added simultaneously with sensitizer | 15 | 0.015 | 110 | 0.7 | Invention |
| 9 | I | 64 | Added simultaneously with sensitizer | 5 | 0.010 | 105 | 0.4 | Invention |
| 10 | J | 64 | Added 60 minutes after addition of sensitizer | 100 | 0.025 | 100 | 2.1 | Comparative Example 3 |

As clearly seen from the results shown in Table 3, when chalcogen sensitization was performed under such conditions that silver chalcogenide should be amorphized, increase of toe sensitivity and reduction of fog and fog with time were favorably observed.

Example 4

In an amount of 20 L of aqueous solution (pH 2) containing 1 g of potassium bromide and 600 g of gelatin, which was kept at 75° C., was added simultaneously with 1500 mL of silver nitrate aqueous solution (1.8 mol/L) and potassium bromide aqueous solution (1 mol/L) over 4 minutes with stirring, while keeping silver electric potential at 0 mV with respect to a saturated calomel electrode. After 3 minute from completion of the addition, the mixture was further added with 13500 mL of silver nitrate aqueous solution (1.8 mol/L) and potassium bromide aqueous solution (1 mol/L) over 36 minutes, while keeping the silver electric potential at −30 mV. After 3 minutes from formation of grains, the temperature was lowered to 35° C., the emulsion was desalted by an ordinary flocculation method, washed with water and added with gelatin and water, and pH and pAg were adjusted to 6.5 and 8.9, respectively.

The resulting silver bromide emulsion was an emulsion containing octahedral grains having monodispersed grain diameters of 0.2 μm and variation coefficient of 11% for grain diameter.

The emulsion was divided into portions, added at 60° C. with sodium thiosulfate ($3.2\times10^{-5}$ mol/mol Ag) and potassium bromoiridate(III) as the amorphizing agent of the present invention, and subjected to post-ripening with conditions of 60° C. and 60 minutes. The amounts of the used amorphizing agent are shown in Table 4 (Samples 11 to 15). As for Sample 16, the amorphizing agent was added 60 minutes after the addition of sodium thiosulfate.

Then, each emulsion was added with gelatin, 4-hydroxy-6-methyl-1,3,3a,7-tetrazaindene, sodium polystyrenesulfonate, phenoxyethanol and sodium dodecylbenzenesulfonate, and coated simultaneously with a protective layer containing gelatin, polymethyl methacrylate particles and 2,4-dichloro-6-hydroxy-s-triazine sodium salt on a triacetyl cellulose film support having an undercoat layer by the co-extrusion method.

The samples were subjected to light exposure for sensitometry (10 seconds) through an optical wedge, developed for 10 minutes at 20° C. with MAA-1 developer having the following composition, and subjected to stopping, fixation, rinsing and drying in a conventional manner, and densities were measured.

Fog was obtained as the minimum optical density of each sample. The relative sensitivity was represented with a relative value of reciprocal of exposure required for obtaining an optical density of fog value+0.2 based on that value of Sample 11, which was taken as 100.

Fog with time (storability) was evaluated by placing a sample prepared by the method described above under forced storage conditions of 60° C. and 80% of relative humidity and then performing development and sensitometry for it as described above.

The amorphization of silver chalcogenide was determined by the method of the present invention. The peak at 2θ=34° was the maximum peak.

TABLE 4

| Sample | Amount of amorphizing agent (μmol/mol Ag) | Addition time of amorphizing agent | Relative intensity of maximum X-ray diffraction peak | Fog | Relative sensitivity | Fog with time | Note |
|---|---|---|---|---|---|---|---|
| 11 | None | — | 100 | 0.02 | 100 | 1.20 | Comparative Example 1 |
| 12 | 0.5 | Added simultaneously with sensitizer | 90 | 0.02 | 100 | 1.20 | Comparative Example 2 |
| 13 | 20.0 | Added simultaneously with sensitizer | 5 | 0.02 | 105 | 0.10 | Invention |
| 14 | 60.0 | Added simultaneously with sensitizer | 1 | 0.02 | 110 | 0.03 | Invention |
| 15 | 200.0 | Added 60 minutes after addition of sensitizer | 0 | 0.02 | 100 | 0.02 | Comparative Example 3 |
| 16 | 200.0 | Added 60 minutes after addition of sensitizer | 100 | 0.02 | 100 | 1.10 | Comparative Example 3 |

As clearly seen from the results shown in Table 4, it was found that amorphization of the chalcogen sensitization centers according to the present invention suppressed fog with time.

Example 5

Also for the silver bromide emulsion containing octahedral grains used in JP-A-2000-231171, Example 3, which was sensitized by gold sulfur sensitization, good results were obtained by the amorphization method used for Emulsion K of Example 4 in the present specification.

Example 6

Also for the silver iodobromide emulsion containing tabular grains used in JP-A-2000-231171, Example 4, which was sensitized by gold sulfur selenium sensitization, good results were obtained by the amorphization method used for Emulsion K of Example 4 in the present specification.

Example 7

Also for the silver chloride emulsion containing tabular grains used in Japanese Patent Application No. 11-359358, Example 1, which was sensitized by gold sulfur sensitization, good results were obtained by the amorphization method used for Emulsion K of Example 4 in the present specification.

What is claimed is:

1. A method for chemical sensitization of a silver halide emulsion comprising a sensitization step of subjecting the silver halide emulsion to chemical sensitization with a chalcogen compound or a combination of a chalcogen compound and a gold compound to produce silver chalcogenide or gold silver chalcogenide, wherein the chemical sensitization is performed under such conditions that at least a part of the silver chalcogenide or gold silver chalcogenide produced in the sensitization step can be amorphized.

2. The method for chemical sensitization of a silver halide emulsion according to claim 1, wherein the chemical sensitization is performed in the presence of transition metal ions of at least one metal selected from the metals of Group IB, Group IIB, Group VIA, Group VIIA and Group VIII.

3. The method for chemical sensitization of a silver halide emulsion according to claim 1, wherein the maximum X-ray diffraction peak intensity of silver chalcogenide or gold silver chalcogenide obtained for a standard model as defined in the following (a) (Intensity A) and the maximum X-ray diffraction peak intensity of silver chalcogenide or gold silver chalcogenide obtained by applying the chemical sensitization conditions of the chemical sensitization step to a simplified model as defined in the following (b) (Intensity B) satisfy the relational equation defined in the following (c):

(a) silver chalcogenide or gold silver chalcogenide produced by mixing 20 mL of 0.01 mol/L silver nitrate aqueous solution, 20 mL of 0.01 mol/L solution of the chalcogen compound in water or an alcohol and, when a gold compound is also used in the chemical sensitization, 0.01 mol/L solution of the gold compound in water or an alcohol in such an amount that the gold compound and the chalcogen compound should exist in the same molar ratio as that used for the chemical sensitization, said mixing being conducted at the temperature used for the chemical sensitization, (b) silver chalcogenide or gold silver chalcogenide produced by mixing the chalcogen compound or a combination of the chalcogen compound and the gold compound with 20 mL of 0.01 mol/L silver nitrate aqueous solution under the same conditions as those of the chemical sensitization, except that the silver halide emulsion does not exist, the chalcogen compound is added as 0.01 mol/L solution in water or an alcohol and the other additives are added in such amounts that molar ratios of the additives with respect to the chalcogen compound should be the same as those used for the chemical sensitization, (c) $B/A \leqq ½$.

4. The method for chemical sensitization of a silver halide emulsion according to claim 1, wherein an amorphizing agent is used in the sensitization step.

5. The method for chemical sensitization of a silver halide emulsion according to claim 1, wherein a gold sensitizer is used in the sensitization step.

6. The method for chemical sensitization of a silver halide emulsion according to claim 5, wherein the gold sensitizer has an organic ligand.

7. The method for chemical sensitization of a silver halide emulsion according to claim 1, wherein reduction sensitization is also performed in the sensitization step.

8. The method for chemical sensitization of a silver halide emulsion according to claim 1, wherein a sensitizing dye is added during the sensitization step or before or after the sensitization step.

9. The method for chemical sensitization of a silver halide emulsion according to claim 1, wherein a nitrogen-containing heterocyclic compound is added during the sensitization step.

10. The method for chemical sensitization of a silver halide emulsion according to claim 1, wherein the silver halide grains are tabular grains having an aspect ratio of 2 or more.

11. The method for chemical sensitization of a silver halide emulsion according to claim 1, wherein the silver halide grains have dislocation lines.

12. The method for chemical sensitization of a silver halide emulsion according to claim 1, wherein the silver halide grains have a portion formed by epitaxial growth.

13. The method for chemical sensitization of a silver halide emulsion according to claim 1, wherein the silver halide grains contain a Group VIII metal or an inorganic or organic hexa-coordinate complex thereof.

14. The method for chemical sensitization of a silver halide emulsion according to claim 1, wherein a compound of Group VIII metal is added as an amorphizing agent within 5 minutes before or after addition of the chalcogen compound in an amount of 1/16 to 16 times the amount of the chalcogen compound.

15. The method for chemical sensitization of a silver halide emulsion according to claim 1, wherein Pt compound is added as an amorphizing agent within 5 minutes before or after addition of the chalcogen compound in an amount of 1/16 to 16 times the amount of the chalcogen compound.

16. The method for chemical sensitization of a silver halide emulsion according to claim 1, wherein a compound of Group VIII metal is added as an amorphizing agent within 2 minutes before or after addition of the chalcogen compound in an amount of 1/4 to 4 times the amount of the chalcogen compound.

17. The method for chemical sensitization of a silver halide emulsion according to claim 1, wherein Pt compound is added as an amorphizing agent within 2 minutes before or after addition of the chalcogen compound in an amount of 1/4 to 4 times the amount of the chalcogen compound.

* * * * *